US006013400A

United States Patent [19]

LaPeruta et al.

[11] Patent Number: 6,013,400

[45] Date of Patent: Jan. 11, 2000

[54] METHOD OF MANUFACTURING A LUMINESCENT SCREEN ASSEMBLY FOR A CATHODE-RAY TUBE

[75] Inventors: Richard LaPeruta, Lititz; Istvan Gorog, Lancaster, both of Pa.

[73] Assignee: Thomson Consumer Electronics, Inc., Indianapolis, Ind.

[21] Appl. No.: 09/020,806

[22] Filed: Feb. 9, 1998

[51] Int. Cl.[7] ..... G03C 5/00; B05D 3/06

[52] U.S. Cl. ..... 430/24; 430/25; 430/26; 396/546; 396/547

[58] Field of Search ..... 427/68; 430/24, 430/25, 26; 398/546, 547

[56] References Cited

U.S. PATENT DOCUMENTS

| | | | |
|---|---|---|---|
| 3,558,310 | 1/1971 | Mayaud | 96/36.1 |
| 3,767,395 | 10/1973 | Rowe et al. | 430/24 |
| 3,779,760 | 12/1973 | Miyaoka | 430/26 |
| 3,979,630 | 9/1976 | Van Ormer | 430/25 |
| 4,032,342 | 6/1977 | Strik | 430/24 |
| 4,070,498 | 1/1978 | Nishizawa et al. | 427/53 |
| 4,921,767 | 5/1990 | Datta et al. | 430/23 |
| 5,455,132 | 10/1995 | Ritt et al. | 430/23 |
| 5,646,478 | 7/1997 | Nosker et al. | 313/402 |

OTHER PUBLICATIONS

A.M. Morrell et al., Color Television Picture Tubes, pp. 80–85 (1974).

*Primary Examiner*—Martin Angebranndt

*Attorney, Agent, or Firm*—Joseph S. Tripoli; Dennis H. Irlbeck

[57] ABSTRACT

The invention relates to a method of manufacturing a luminescent screen structure 22 with a light-absorbing matrix 23, having a plurality of substantially equally sized openings therein, on an inner surface of a CRT faceplate panel 12. A color selection electrode 24 is spaced a distance, Q, from the inner surface. The method includes providing a first photoresist layer 50, whose solubility is altered when it is exposed to light, on the inner surface of the faceplate panel 12. The first photoresist layer 50 is exposed to light from two symmetrically located source positions +G and −G, relative to a central source position, 0. Then the more soluble regions 54 of the photoresist layer 50 are removed, overcoated with a light-absorbing material 58 and developed to remove the retained, less soluble regions 52 of the first photoresist layer with the light-absorbing material thereon. First guardbands 60 of light-absorbing material remain on the interior surface of the faceplate panel 12. The process is repeated twice more, using second and third photoresist layers 70 and 90 and two asymmetrically located light source positions +B, −B and +R, −R, respectively to produce second and third guardbands 80 and 100.

2 Claims, 14 Drawing Sheets

METHOD OF MANUFACTURING A LUMINESCENT SCREEN ASSEMBLY FOR A CATHODE-RAY TUBE

This invention relates to a method of manufacturing a luminescent screen assembly, including a light-absorbing matrix, for a cathode-ray tube (CRT) and, more particularly, to a method of making a matrix using a color selection electrode having openings substantially greater in width than the width of the resultant matrix openings.

BACKGROUND OF THE INVENTION

FIG. 1 shows a shadow mask 2 and a viewing faceplate 18 of a conventional CRT having a screen assembly 22 thereon. The shadow mask 2 includes a plurality of rectangular openings 4, only one of which is shown. The screen assembly 22 includes a light-absorbing matrix 23 with rectangular openings in which blue-, green-, and red-emitting phosphor lines, B, G, and R, respectively, are disposed. Three color-emitting phosphors and the matrix lines, or guardbands, therebetween comprise a triad having a width or screen pitch, p, of about 0.84 mm (33 mils). The guardbands are designated hereinafter as RB, for the guardbands between the red- and blue-emitting phosphor lines; RG, for the guardbands between the red- and green-emitting phosphor lines; and BG, for the guardbands between the blue- and green-emitting phosphor lines. For the conventional shadow mask 2, the mask openings 4 have a width, a, not greater than one third the width, p, of the triad. In a CRT having a diagonal dimension of 51 cm (20 inches), the width, a, of the shadow mask openings 4 are on the order of about 0.23 mm (9 mils) and the resultant openings formed in the matrix have a width, b, of about 0.18 mm (7 mils). The guardbands of the matrix 23, between the adjacent phosphor lines, have a width, c, of about 0.1 mm (4 mils). The matrix 23, preferably, is formed on the viewing faceplate 18 by the process described in U.S. Pat. No. 3,558,310, issued to Mayaud on Jan. 26, 1971. Briefly, a film of a suitable photoresist, whose solubility is altered by light, is provided on the viewing faceplate. The photoresist film is exposed, through the openings 4 in the shadow mask 2, to ultraviolet light from a conventional three-in-one lighthouse, not shown. After each exposure, the light is moved to a different position, within the lighthouse, to duplicate the incident angles of the electron beams from the electron gun of the CRT. Typically, the three electron beam positions, designated 6, 7 and 8, are spaced a distance, $X_O$, about 5.38 mm (212 mils) apart, as shown in FIG. 2. Three exposures are required, from the three different lamp positions, to complete the matrix exposure process. Then, the regions of the film with greater solubility are removed by flushing the exposed film with water, thereby uncovering bare areas of the faceplate panel. Next, the interior surface of the faceplate panel is overcoated with a black matrix slurry, of the type known in the art, which, when dried, is adherent to the uncovered areas of the faceplate panel. Finally, the matrix material overlying the retained film regions, as well as the retained film regions, are removed, leaving the matrix layer on the previously uncovered areas of the faceplate panel. Again with reference to FIG. 1, the difference between the width, a, of the shadow mask openings and the width, b, of the matrix openings is referred to as "print down." Thus, in the conventional shadow mask-type CRT of FIG. 1, having mask openings with a width of 0.23 mm and matrix openings with a width of 0.18 mm, the typical "print down" is about 0.05 mm (2 mils). A drawback of the shadow mask-type CRT is that, at the center of the screen, the shadow mask intercepts all but about 18–22% of the electron beam current; that is, the shadow mask is said to have a transmission of only about 18–22%. Thus, the area of the openings 4 in the shadow mask 2 is about 18–22% of the area of the mask. Because there are no focusing fields associated with the shadow mask 2, a corresponding portion of the screen assembly 22 is excited by the electron beams.

In order to increase the transmission of the color selection electrode without increasing the size of the excited portions of the screen, a post-deflection focusing color selection structure is required. The focusing characteristics of such a structure permit larger aperture openings to be utilized to obtain greater electron beam transmission than can be obtained with the conventional shadow mask. One such structure, a uniaxial tension focus mask, is described in U.S. Pat. No. 5,646,478 issued to R. W. Nosker et al. on Jul. 8, 1997. A drawback of using a post deflection color selection electrode, such as a tension focus mask, is that conventional methods for forming the matrix cannot be utilized, because the prior methods provide only about a 0.05 mm (2 mil) "print down." For the tension focus mask of U.S. Pat. No. 5,646,478, the triad period, p, of the screen assembly is the same as for a CRT with a conventional shadow mask, so the matrix openings are about 0.18 mm wide. However, as described hereinafter, for a tension focus mask-type CRT, a "print down" of about 0.37 mm (14.5 mils) is required. Such a high degree of "print down" cannot be achieved with the conventional matrix process described above. Additionally, for a tension focus mask-type CRT, any matrix opening patterns formed using a conventional three-in-one lighthouse process, such as that taught by Mayaud, referenced above, will result in misregister of the electron beams which impinge upon the blue- and red-emitting phosphors with "Q"-space errors. The dimension "Q" is the distance between the color selection electrode and the inner surface of the faceplate. "Q"-space errors of the order of +/−5%, that is variations in the focus mask-to-screen spacing caused by deviations of the faceplate thickness or curvature from the bogie dimensions, are typical. Accordingly, a new method of making a matrix with the capability for very large "print down" with no electron beam misregister is required.

SUMMARY OF THE INVENTION

The present invention relates to a method of manufacturing a luminescent screen assembly, having a light-absorbing matrix with a plurality of substantially equally sized openings therein, on an inner surface of a faceplate panel of a cathode-ray tube. The tube has a color selection electrode spaced from the inner surface of the faceplate panel by a distance, Q. The method includes the steps of providing a first photoresist layer, whose solubility is altered when exposed to light, on the inner surface of the faceplate panel. The first photoresist layer is exposed to light from a lamp located, relative to a central source position, 0, at two symmetrical source positions. The exposure selectively alters the solubility of the illuminated areas of the first photoresist layer to produce regions with greater solubility and regions of lesser solubility. The regions of greater solubility are removed to uncover areas of the inner surface of the faceplate panel, while the regions of lesser solubility are retained. The inner surface of the faceplate panel and the retained regions of the first photoresist layer are overcoated with a composition of light-absorbing material. The retained regions of the first photoresist layer and the light-absorbing material thereon are removed, thereby uncovering portions of the inner surface of the faceplate panel while retaining the first guardbands of light-absorbing material that is adhered to the inner surface of the faceplate panel. The process is repeated again with second and third photoresist layers. The exposure of the second and third photoresist layers through the color selection electrode occurs with the lamp located at additional asymmetrical source positions relative to the central source position, 0. The subsequent overcoating with light-absorbing material and removal of selective regions thereof uncover portions of the inner surface of the faceplate panel while retaining second and third guardbands of light-absorbing material that is adhered to the inner surface of the faceplate panel. Then, phosphor materials are deposited on the uncovered portions of the inner surface of the faceplate panel to complete the screen assembly.

DETAILED DESCRIPTION OF THE PREFERRED EMBODIMENT

Figure 1:
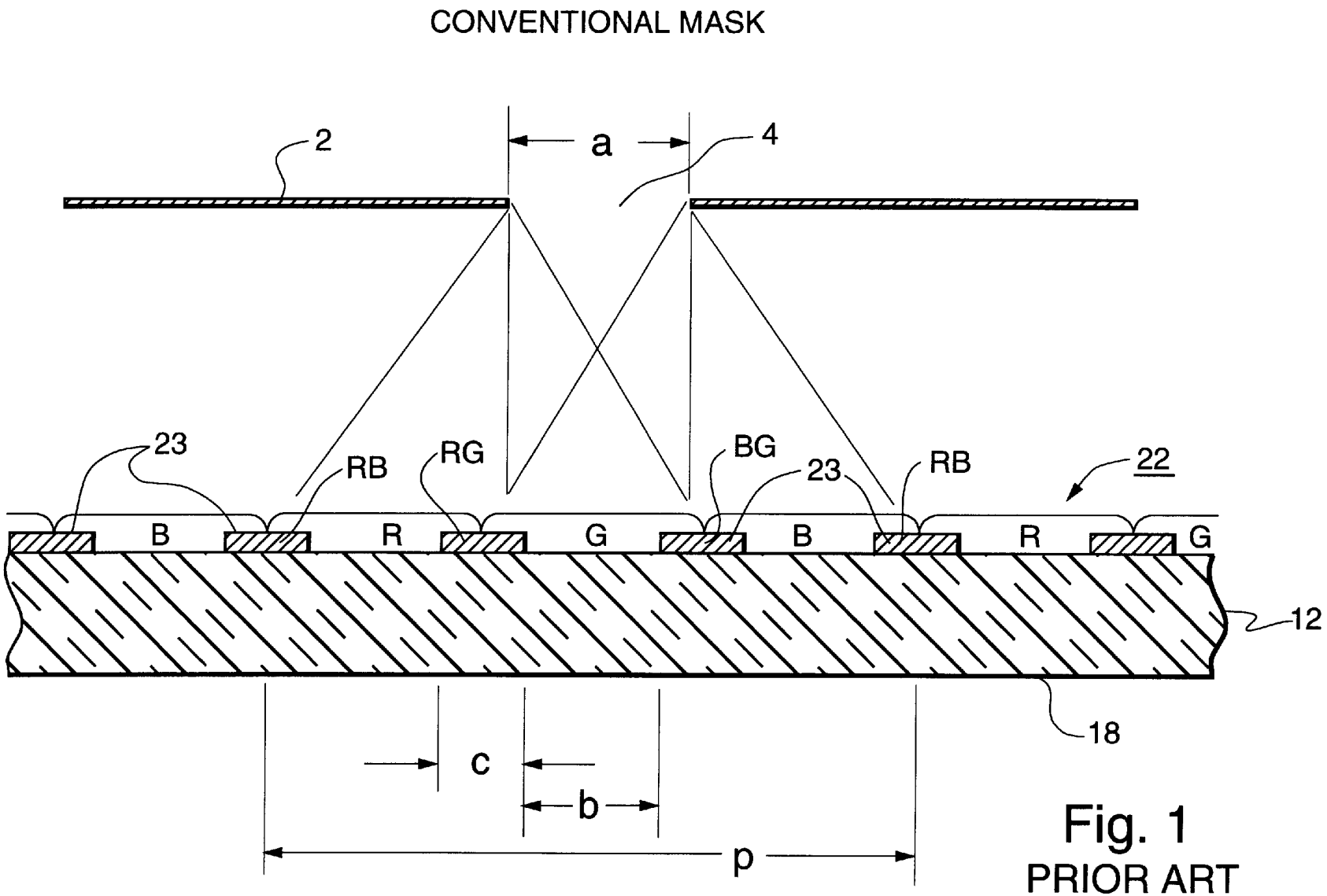
Fig. 1 PRIOR ART
FIG. 1 is an enlarged sectional view of a portion of a conventional shadow mask and screen assembly of a CRT demonstrating "print down"
Figure 2:
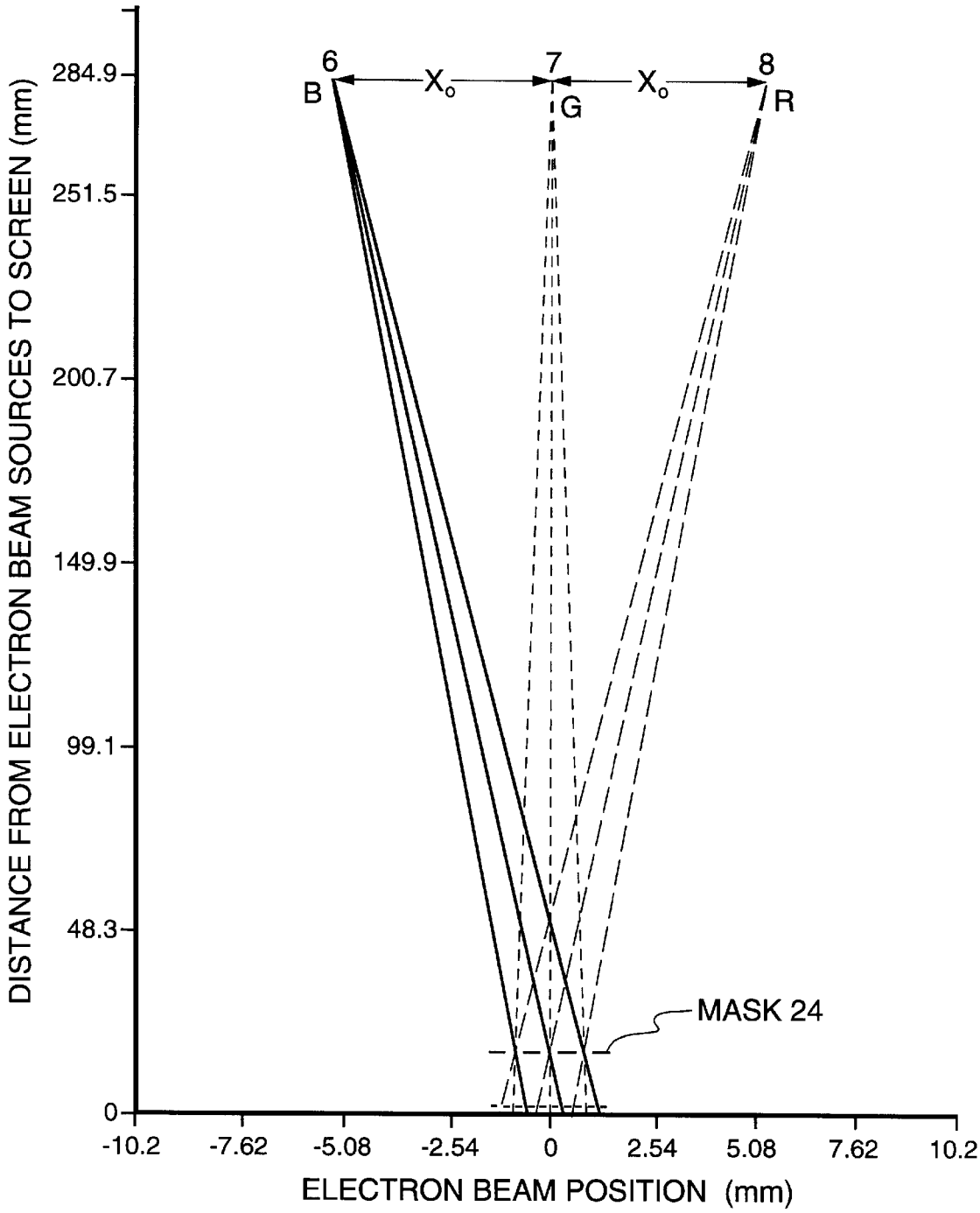
FIG. 2 shows the three electron beam positions, B, G and R within the CRT.
Figure 3:
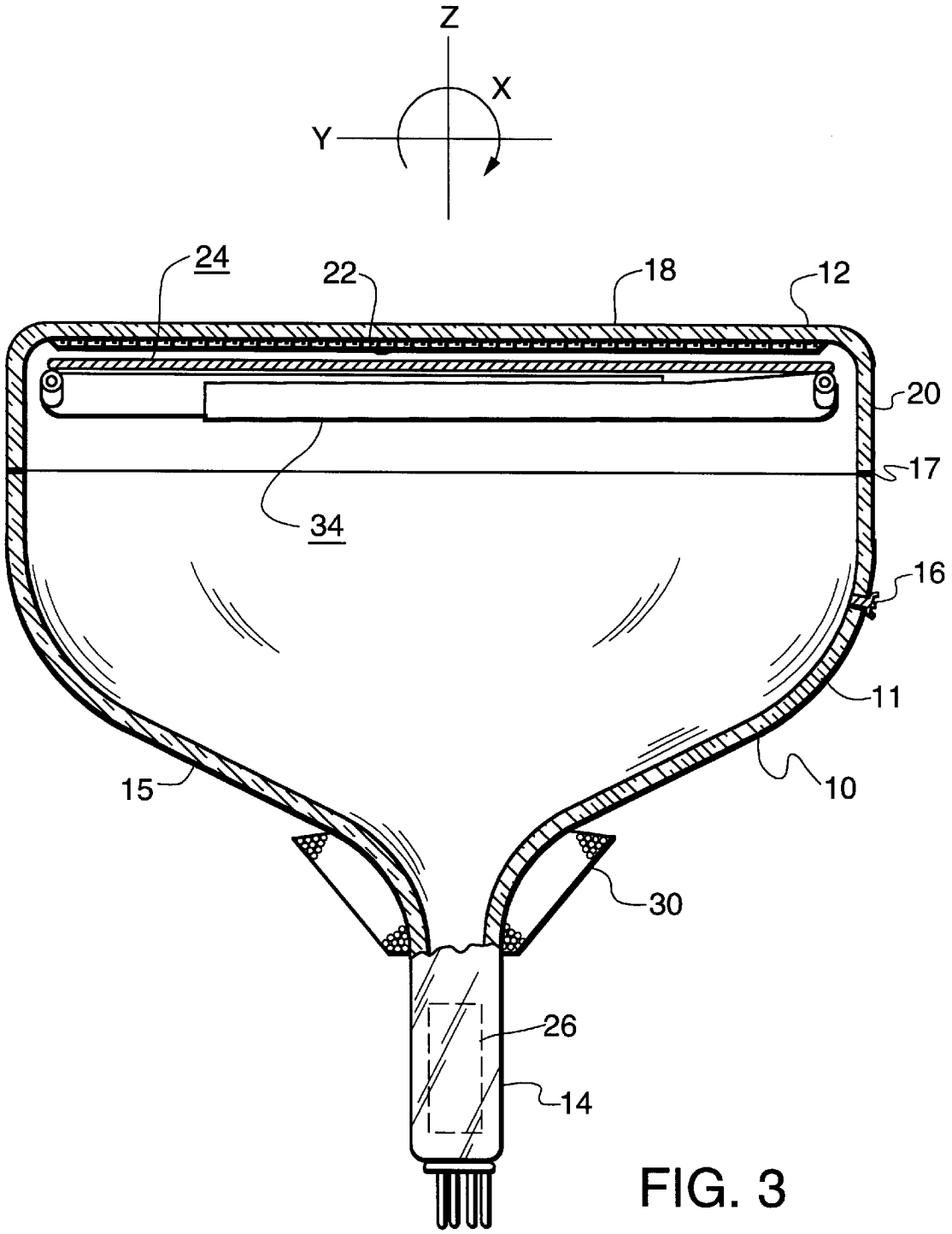
FIG. 3 is a plan view, partly in axial section, of a color CRT made according to the present invention.

FIG. 3 shows a cathode-ray tube 10 having a glass envelope 11 comprising a rectangular faceplate panel 12 and a tubular neck 14 connected by a rectangular funnel 15. The funnel has an internal conductive coating (not shown) that extends from an anode button 16 to the neck 14. The faceplate panel 12 comprises a cylindrical viewing faceplate 18 and a peripheral flange or sidewall 20 that is sealed to the funnel 15 by a glass frit 17. A three-color phosphor screen assembly 22 is carried by the inner surface of the viewing faceplate 18. The screen assembly 22 is a line screen with the blue-, green-, and red-emitting phosphors arranged in triads, each triad including a phosphor line of each of the three colors separated by guardbands of a light-absorbing matrix 23, shown in FIG. 4. A multi-apertured color selection electrode, such as a tension focus mask, 24 is removably mounted within the faceplate panel 12, in predetermined spaced relation to the screen assembly 22. This distance is referred to as the "Q" spacing. An electron gun 26, shown schematically by the dashed lines in FIG. 3, is centrally mounted within the neck 14 to generate and direct three inline electron beams (shown in FIG. 2) along convergent paths through the tension focus mask 24 to the screen assembly 22. The electron gun is conventional and may be any suitable gun known in the art.

The CRT 10 is designed to be used with an external magnetic deflection yoke, such as the yoke 30, shown in the neighborhood of the funnel-to-neck junction. When activated, the yoke 30 subjects the three electron beams to magnetic fields that cause the beams to scan a horizontal and vertical rectangular raster over the screen assembly 22.

Figure 4:
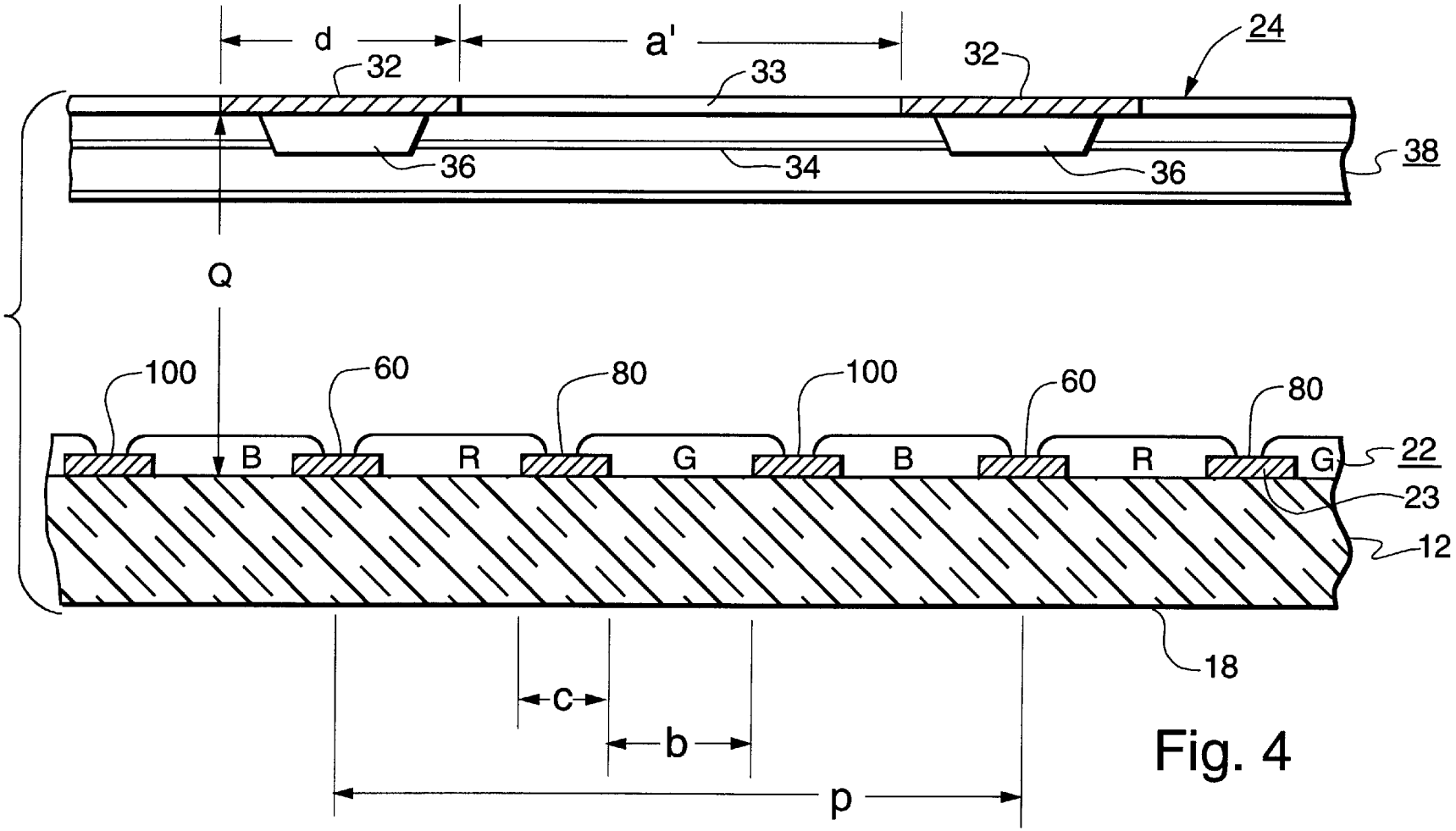
FIG. 4 is an enlarged sectional view of a portion of a tension focus mask and screen assembly of the CRT of FIG. 3.
Figure 5:
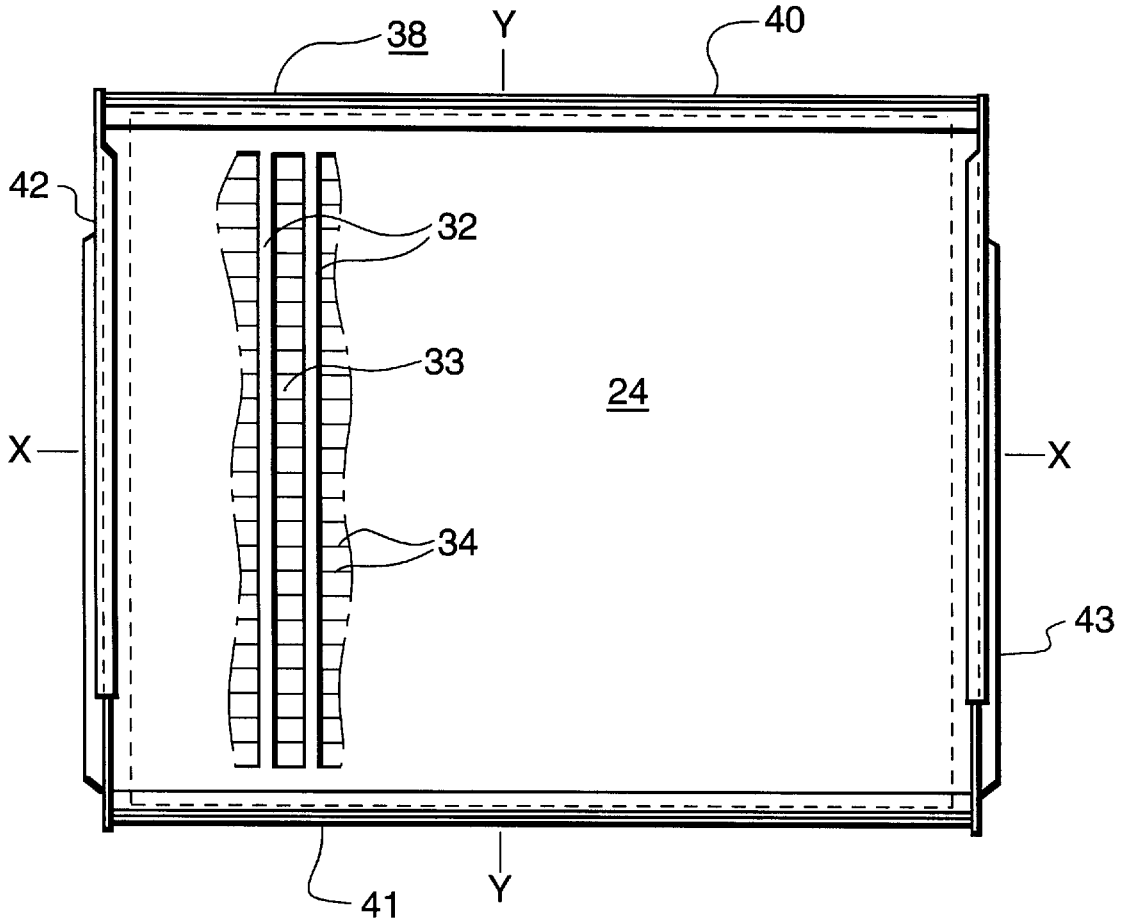
FIG. 5 is a plan view of the tension focus mask and frame used in the CRT of FIG. 3.

As is known in the art, an aluminum layer (not shown) overlies the screen assembly 22 and provides an electrical contact thereto, as well as a reflective surface to direct light, emitted by the phosphors, outwardly through the viewing faceplate 18. As shown in FIG. 5, the tension focus mask 24 is formed, preferably, from a thin rectangular sheet of about 0.05 mm (2 mil) thick low carbon steel, that includes two long sides and two short sides. The two long sides of the tension focus mask parallel the central major axis, X, of the mask and the two short sides parallel the central minor axis, Y, of the mask. With reference to FIGS. 4 and 5, the tension focus mask 24 includes an apertured portion that contains a plurality of first elongated strands 32 separated by slots 33 that parallel the minor axis, Y, of the mask.

In a first embodiment of the invention, for example, in a CRT having a diagonal dimension of 68 cm (27 inches), the mask pitch, defined as the transverse dimension of a first strand 32 and an adjacent slot 33, is about 0.85 mm (33.5 mils). As shown in FIG. 4, each of the first strands 32 has a transverse dimension, or width, d, of about 0.36 mm (14 mils) and each of the slots 33 has a width, a', of about 0.49 mm (19.5 mils). The slots 33 extends from near one long side of the tension focus mask to near the other long side thereof. A plurality of second strands 34, each having a diameter of about 0.025 mm (1 mil), are oriented substantially perpendicular to the first strands 32 and spaced therefrom by insulators 36. A frame 38 for the tension focus mask 24 includes four major members that are shown in FIG. 5, two torsion members 40 and 41 and two side members 42 and 43. The two torsion members, 40 and 41, parallel the major axis, X, and each other. The long sides of the tension focus mask 24 are welded between the two torsion members 40 and 41 which provide the necessary tension to the mask 24. Again with reference to FIG. 4, the screen 22, formed on the viewing faceplate 18, includes the light-absorbing matrix 23 with rectangular openings in which the B, G, and R color emitting phosphor lines are disposed. The corresponding matrix openings have an optimum, or bogie, width, b, of about 0.173 mm (6.8 mils). The optimum width, c, of each matrix line, or guardband, is about 0.127 mm (5 mils) and each phosphor triad has a width or screen pitch, p, of about 0.91 mm (35.8 mils). For this embodiment, the tension focus mask 24 is spaced at a distance, Q, of about 15.1 mm (593.3 mils) from the center of the interior surface of the faceplate panel 12.

Figures 6, 8, 9, 10:
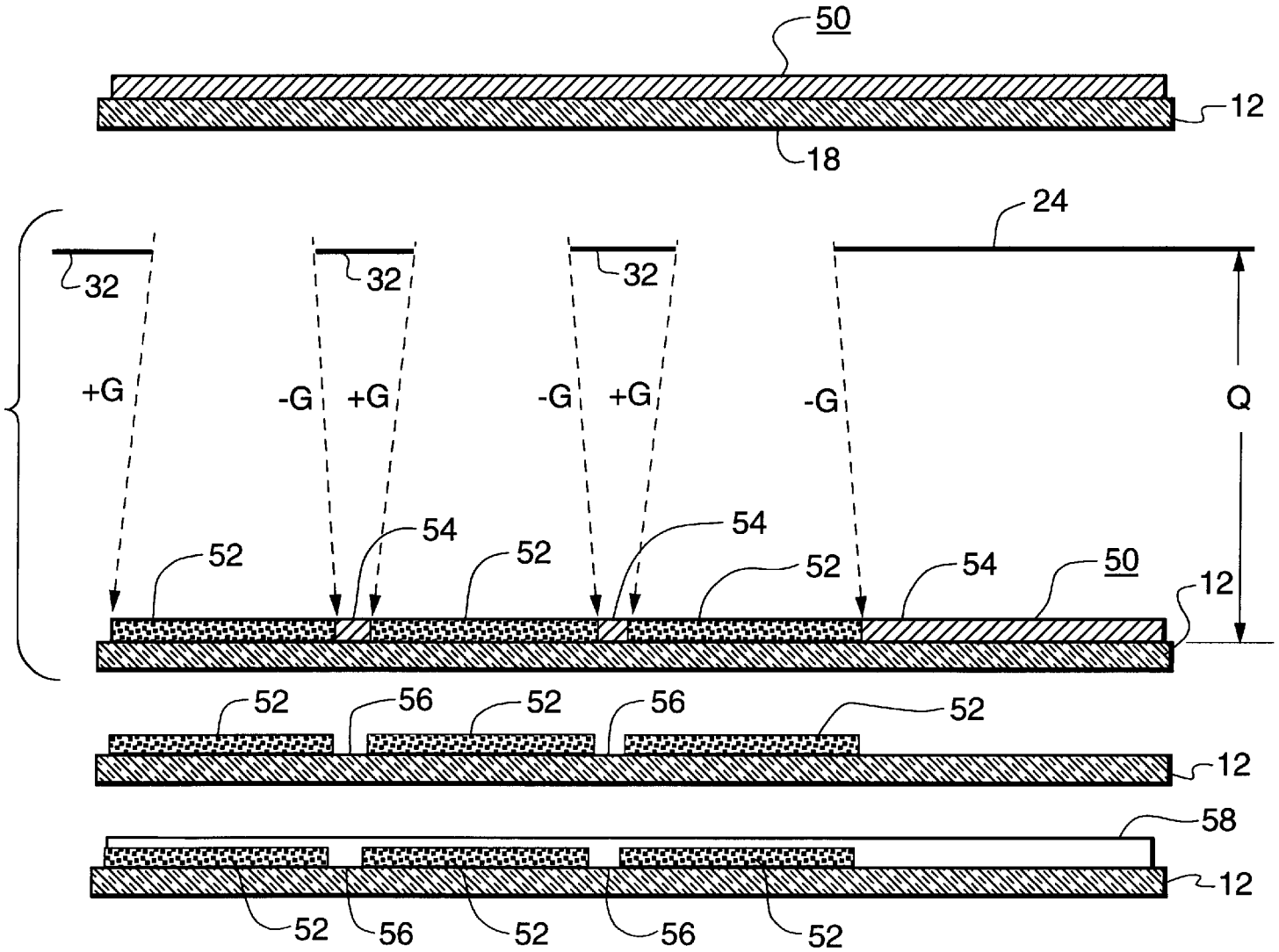
FIG. 6 shows a first step in the manufacturing process in which a portion of a CRT faceplate panel has a first photoresist layer disposed on the interior surface thereof.
FIG. 8 is an enlargement of the area within circle 8 of FIG. 7, showing the second step in the present process in which regions of greater solubility and lesser solubility are produced in the first photoresist layer.
FIG. 9 shows a third step in the process in which the more soluble regions of the first photoresist layer are removed, leaving the retained regions of lesser solubility.
FIG. 10 shows a fourth step in the process in which a composition of a light-absorbing material is overcoated on the inner surface of the panel and the retained regions of lesser solubility of the first photoresist layer.
Figure 7:
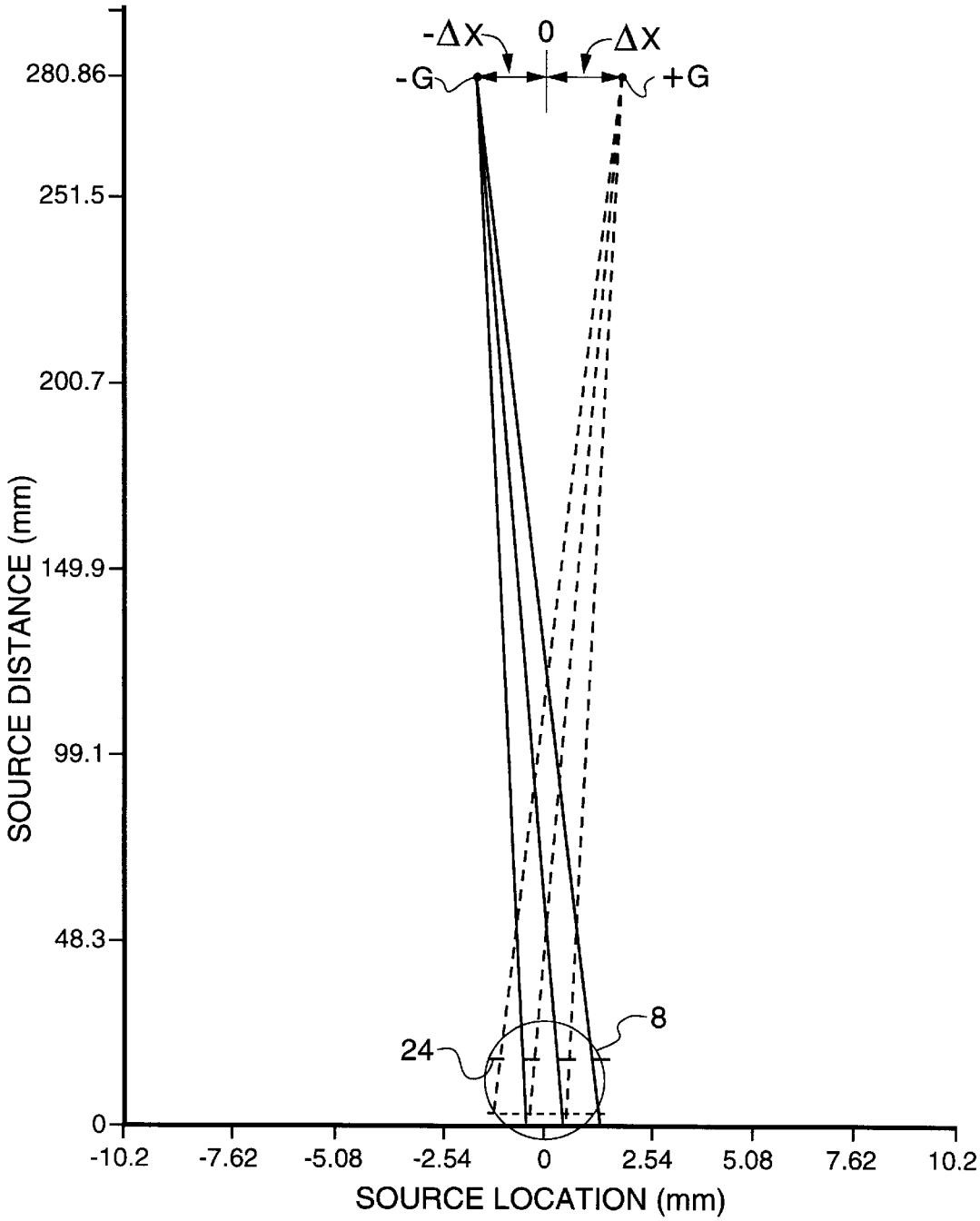
FIG. 7 shows light from a first lamp position, +G, and a second lamp position, −G, passing through the tension focus mask and illuminating areas of the first photoresist layer.

The novel process for manufacturing the matrix 23, using the tension focus mask 24 in which the mask slots 33 are wider than the mask strands 32, is shown in FIGS. 6–23. After the faceplate panel 12 is cleaned, by conventional means, a negative acting photoresist material is provided on the inner surface thereof to form a first photoresist layer 50. As shown in FIGS. 7 and 8, the first photoresist layer 50 is exposed to light, through the tension focus mask 24, from at least two source positions, +G and −G, within a lighthouse (not shown). The first source position, +G, is located a distance ΔX of about 1.78 mm (70 mils) relative to a central source position, 0. The second source position, −G, is symmetrically located a distance −ΔX of about −1.78 mm (−70 mils) from the central source position, 0. The longitudinal spacing of the source positions, +G and −G, from the first photoresist layer 50 is about 280.86 mm (11.0573 inches). As shown in FIG. 8, the Q-spacing between the tension focus mask 24 and the inner surface of the faceplate on which the first photoresist layer 50 is disposed is about 15.1 mm (593.3 mils). The light emanating from source positions +G and −G selectively alters the solubility of the illuminate areas of the first photoresist layer 50, thereby producing regions 52 of lesser solubility. The areas of the first photoresist layer 50 that are shaded by the mask strands 32 are unchanged and constitute regions 54 of greater solubility. As shown in FIG. 9, the photoresist is developed with water, thereby removing the regions of greater solubility and uncovering areas 56 of the inner surface of the faceplate panel 12 underlying the regions of greater solubility, while retaining those regions 52 of the first photoresist layer 50 with lesser solubility.

Figure 11:
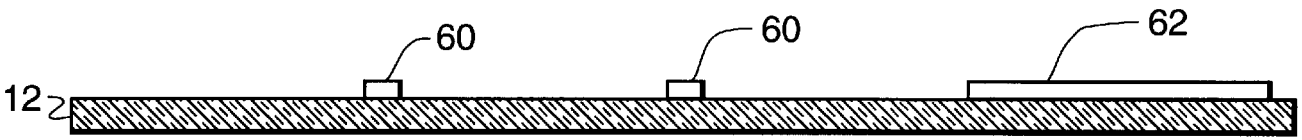
FIG. 11 shows a fifth step in the process in which the retained regions of lesser solubility and the overlying light-absorbing material is removed uncovering portions of the inner surface of the faceplate panel while retaining first guardbands of light-absorbing material adhered to the inner surface of the faceplate panel.

As shown in FIG. 10, the uncovered areas 56 and the retained regions 52 of lesser solubility on the inner surface of the faceplate panel 12 are overcoated with a composition of light-absorbing material 58. The light absorbing material 58 adheres to the inner surface of the faceplate panel 12 in the uncovered areas 56. Preferably, the light-absorbing material is a graphite composition available from Acheson Colloids Co., Port Huron, Mich. Then, the retained regions 52 of the first photoresist layer and the light-absorbing material thereon are removed using an aqueous solution of a chemically digestive agent, as is known in the art. As shown in FIG. 11, first guardbands 60 and a border 62 of light-absorbing material adheres to the inner surface of the facpelate panel 12.

Figure 12:
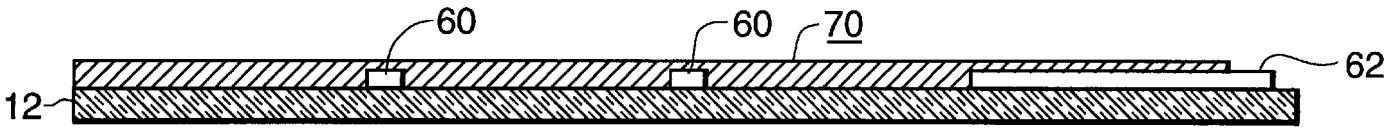
FIG. 12 shows a sixth step in the manufacturing process in which the uncovered portions of the inner surface of the CRT faceplate panel and the first guardbands have a second photoresist layer disposed thereon.
Figure 14:
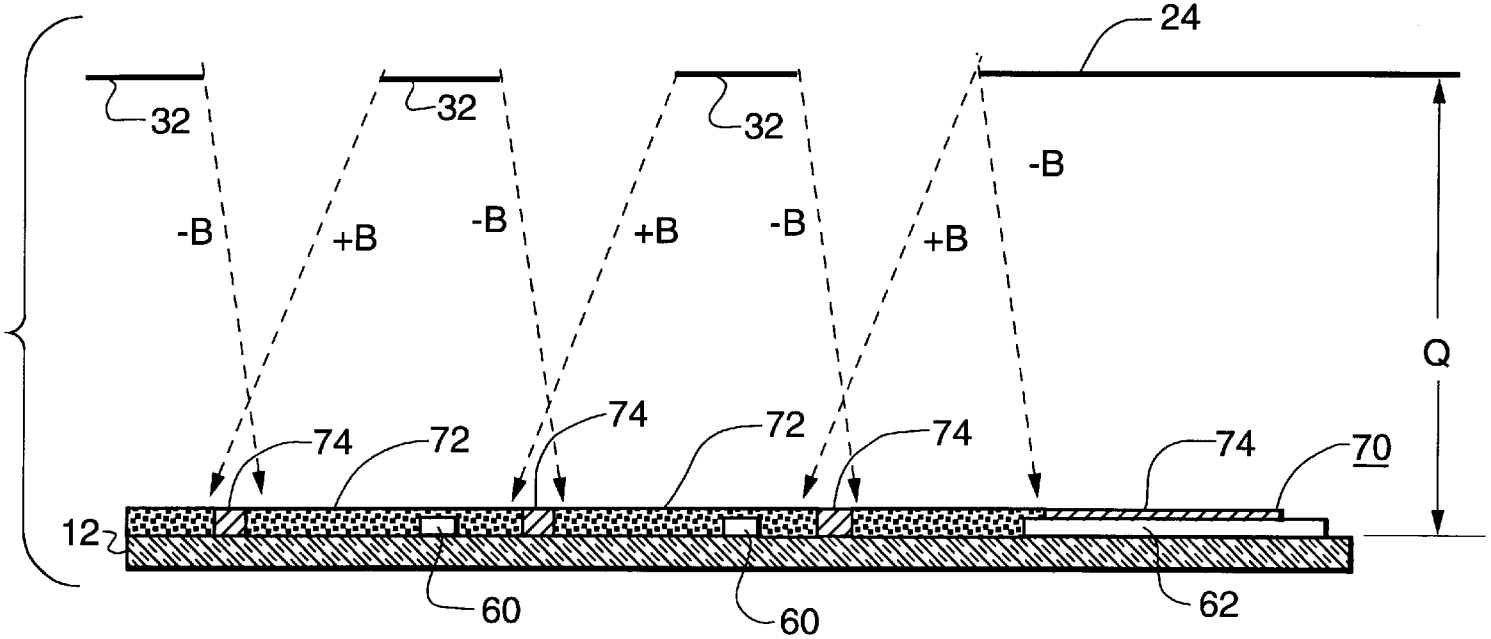
FIG. 14 is an enlargement of the area within circle 14 of FIG. 13, showing the seventh step in the present process in which regions of greater solubility and lesser solubility are produced in the second photoresist layer.
Figure 13:
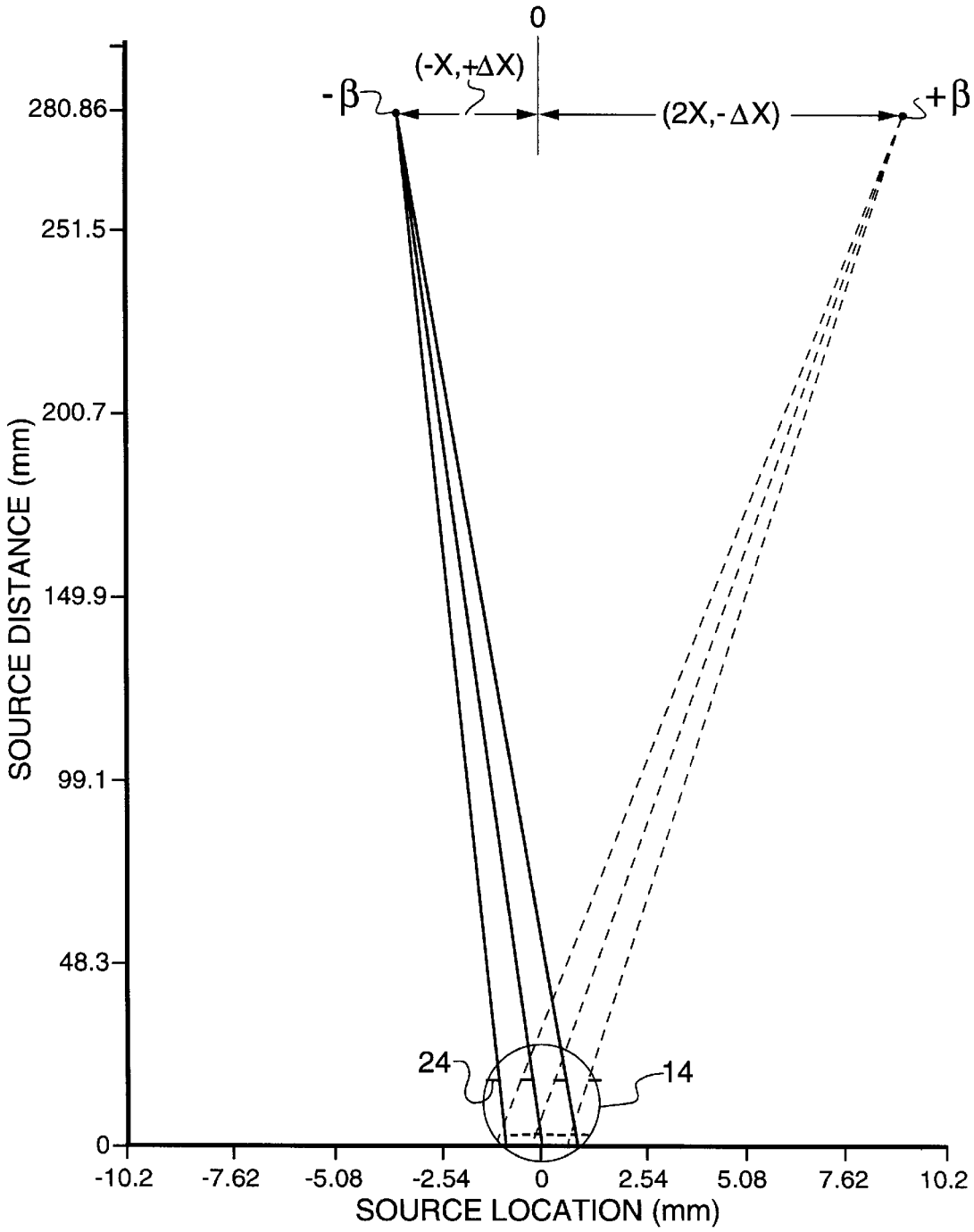
FIG. 13 shows light from a third lamp position, +B, and a fourth lamp position, −B, passing through the tension focus mask and illuminating areas of the second photoresist layer.
Figure 15:
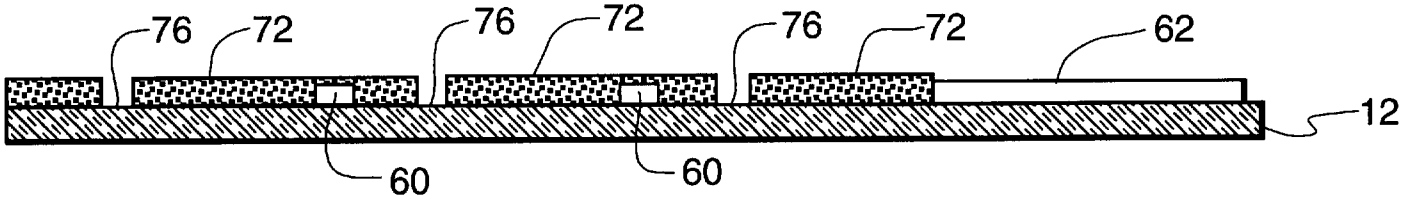
FIG. 15 shows an eighth step in the process in which the more soluble regions of the second photoresist layer are removed, uncovering areas of said inner surface of said faceplate panel while leaving the retained regions of said second photoresist layer having lesser solubility.

With reference to FIG. 12, the process is repeated again by providing the negative acting photoresist material on the inner surface of the faceplate panel 12 to form a second photoresist layer 70. As shown in FIGS. 13 and 14, the second photoresist layer 70 is exposed to light, through the tension focus mask 24, from at least two source positions, +B and −B, within a lighthouse (not shown). The third source position, +B, is asymmetrically located a distance $2X_1-\Delta X$ of about 8.99 mm (354 mils) relative to a central source position, 0. The fourth source position, −B, is asymmetrically located a distance $-X_1+\Delta X$ of about −3.61 mm (−142 mils) from the central source position, 0. The longitudinal spacing of the source positions, +B and −B, from the first photoresist layer 50 remains at about 280.86 mm (11.0573 inches) from the second photoresist layer 70. As shown in FIG. 14, the Q-spacing between the tension focus mask 24 and the inner surface of the faceplate on which the second photoresist layer 70 is disposed remains at about 15.1 mm (593.3 mils). The light emanating from source positions +B and −B selectively alters the solubility of the illuminate areas of the second photoresist layer 70, thereby producing regions 72 of lesser solubility. The areas of the second photoresist layer 70 that are shaded by the mask strands 32 are unchanged and constitute regions 74 of greater solubility. As shown in FIG. 15, the photoresist is developed with water, thereby removing the regions of greater solubility and uncovering areas 76 of the inner surface of the faceplate panel 12 underlying the regions of greater solubility, while retaining those regions 72 of the second photoresist layer 70 with lesser solubility.

Figure 16:
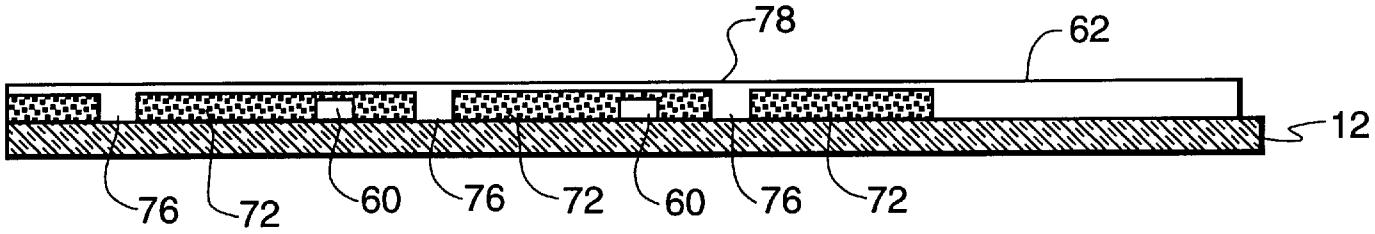
FIG. 16 shows a ninth step in the process in which the composition of the light-absorbing material is overcoated onto the inner surface of the panel and the retained regions of lesser solubility of the second photoresist layer.
Figure 17:
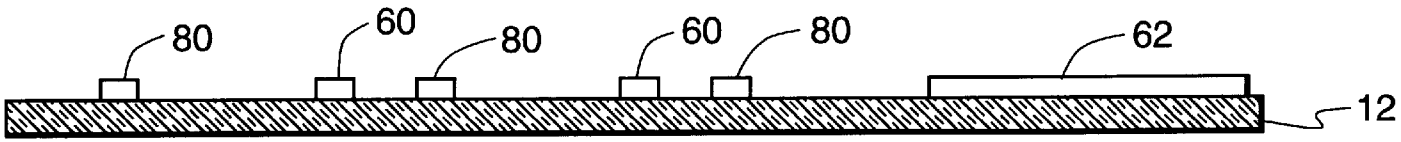
FIG. 17 shows a tenth step in the process in which the retained regions of lesser solubility and the overlying light-absorbing material is removed uncovering portions of the inner surface of the faceplate panel while retaining second guardbands of light-absorbing material adhered to the inner surface of the faceplate panel.

As shown in FIG. 16, the formerly uncovered areas 76 and the retained regions 72 of lesser solubility on the inner surface of the faceplate panel 12 are overcoated with a composition of light-absorbing material 78. The light absorbing material 78 adheres to the inner surface of the faceplate panel 12 in the formerly uncovered areas 76. Then, the retained regions 72 of the second photoresist layer and the light-absorbing material thereon are removed using an aqueous solution of a chemically digestive agent, as is known in the art. As shown in FIG. 17, newly formed second guardbands 80 and the previously formed first guardbands 60 are retained on the inner surface of the faceplate panel 12.

Figure 18:
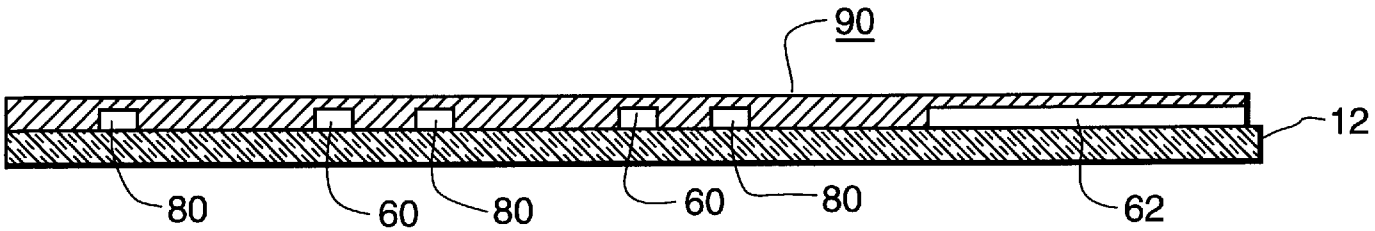
FIG. 18 shows an eleventh step in the manufacturing process in which the uncovered portions of the inner surface of the CRT faceplate panel and the first and second guardbands have a third photoresist layer disposed thereon.
Figure 19:
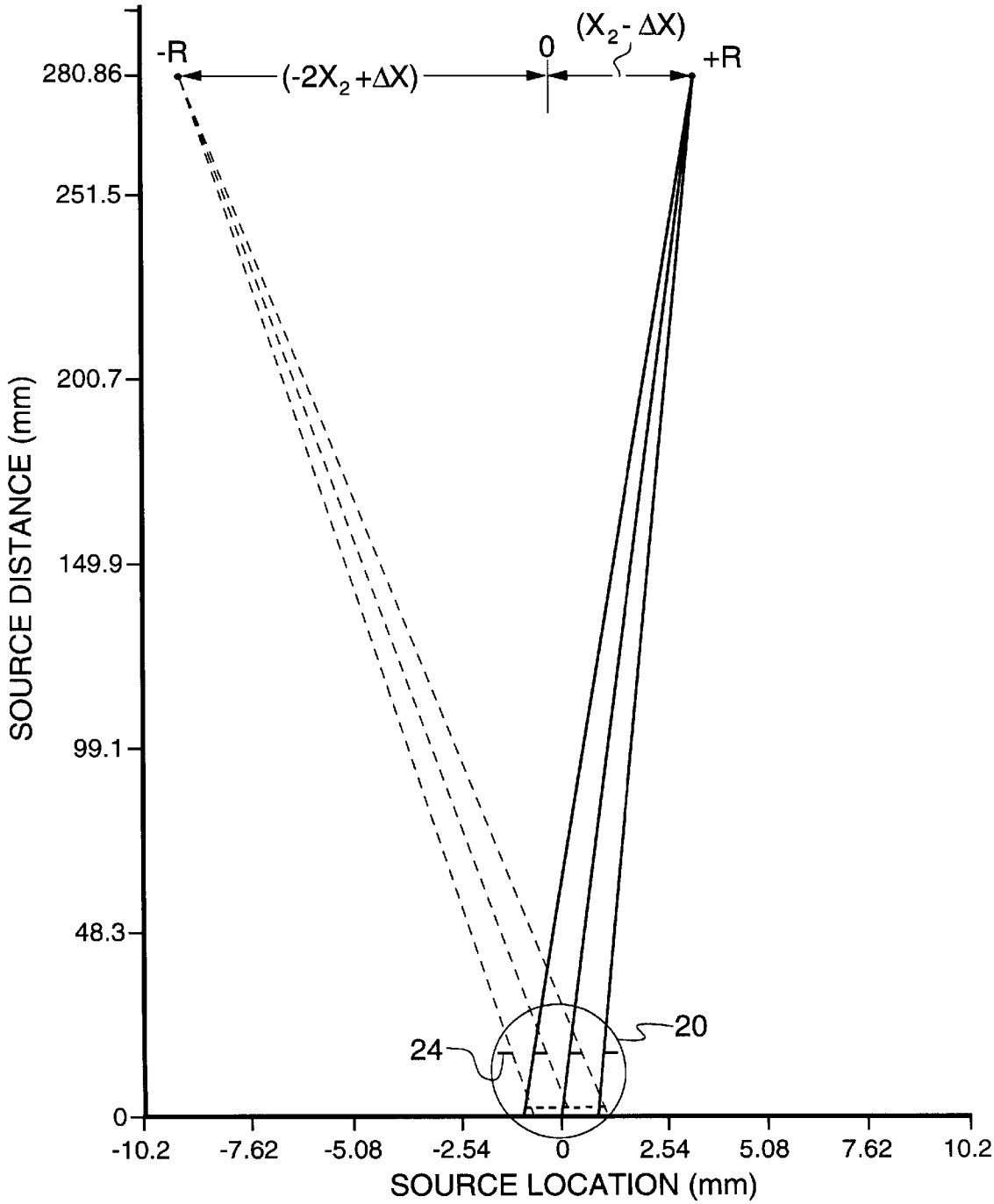
FIG. 19 shows light from a fifth lamp position, +R, and a sixth lamp position, −R, passing through the tension focus mask and illuminating areas of the third photoresist layer.
Figures 20, 21, 22, 23:
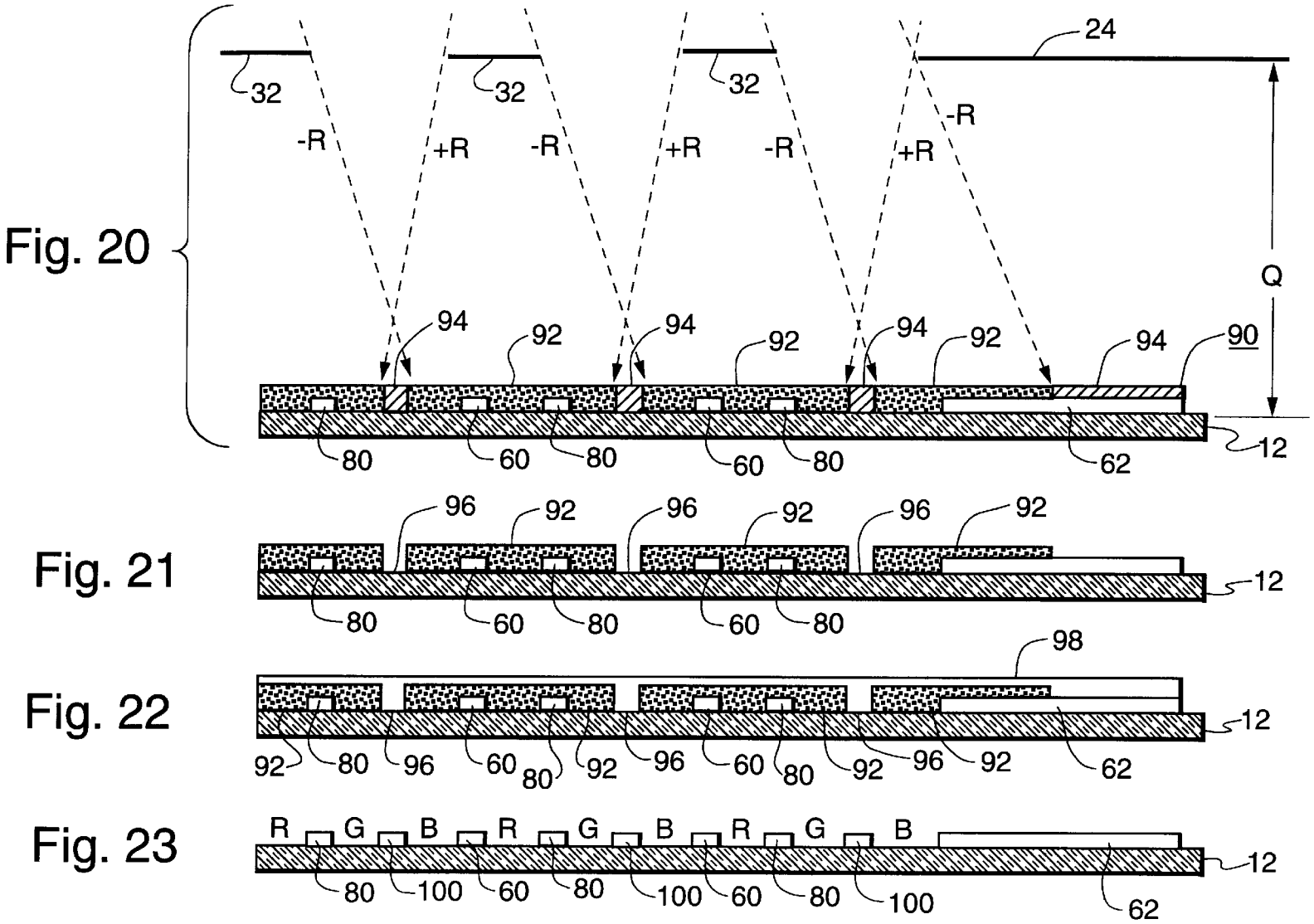
FIG. 20 is an enlargement of the area within circle 20 of FIG. 19, showing the twelfth step in the present process in which regions of greater solubility and lesser solubility are produced in the third photoresist layer.
FIG. 21 shows the thirteenth step in the process in which the more soluble regions of the third photoresist layer are removed, uncovering areas of said inner surface of said faceplate panel while leaving the retained regions of said third photoresist layer having lesser solubility.
FIG. 22 shows the fourteenth step in the process in which the composition of the light-absorbing material is overcoated onto the inner surface of the panel and the retained regions of lesser solubility of the third photoresist layer.
FIG. 23 shows the fifteenth step in the process in which the retained regions of lesser solubility and the overlying light-absorbing material is removed uncovering portions of the inner surface of the faceplate panel and third guardbands of light-absorbing material adhered to the inner surface of the faceplate panel.

The process is repeated for a third time, as shown in FIG. 18. The negative acting photoresist material is provided on the inner surface of the faceplate panel 12 to form a third photoresist layer 90. As shown in FIGS. 19 and 20, the third photoresist layer 90 is exposed to light, through the tension focus mask 24, from at least two source positions, +R and −R, within a lighthouse (not shown). The fifth source position, +R, is asymmetrically located a distance $X_2-\Delta X$ of about 3.61 mm (142 mils) relative to a central source position, 0. The sixth source position, −R, is asymmetrically located a distance $-2X_2+\Delta X$ of about −8.99 mm (−354 mils) from the central source position, 0. The longitudinal spacing of the source positions, +R and −R, from the third photoresist layer 90 remains at about 280.86 mm (11.0573 inches). As shown in FIG. 20, the Q-spacing between the tension focus mask 24 and the inner surface of the faceplate on which the third photoresist layer 90 is disposed remains at about 15.1 mm (593.3 mils). As shown in FIG. 20, the light emanating from source positions +R and −R selectively alters the solubility of the illuminate areas of the third photoresist layer 90, thereby producing regions 92 of lesser solubility. The areas of the third photoresist layer 90 that are shaded by the mask strands 32 are unchanged and constitute regions 94 of greater solubility. As shown in FIG. 21, the photoresist is developed with water, thereby removing the regions of greater solubility and uncovering areas 96 of the inner surface of the faceplate panel 12 underlying the regions of greater solubility, while retaining those regions 92 of the third photoresist layer 90 with lesser solubility.

As shown in FIG. 22, the formerly uncovered areas 96 and the retained regions 92 of lesser solubility on the inner surface of the faceplate panel 12 are overcoated with a composition of light-absorbing material 98. The light absorbing material 98 adheres to the inner surface of the faceplate panel 12 in the formerly uncovered areas 96. Then, the retained regions 92 of the third photoresist layer and the light-absorbing material thereon are removed using an aqueous solution of a chemically digestive agent, as is known in the art. As shown in FIG. 23, newly formed third guardbands 100 and the previously formed first and second guardbands 60 and 80, are retained on the inner surface of the faceplate panel 12.

Figure 24:
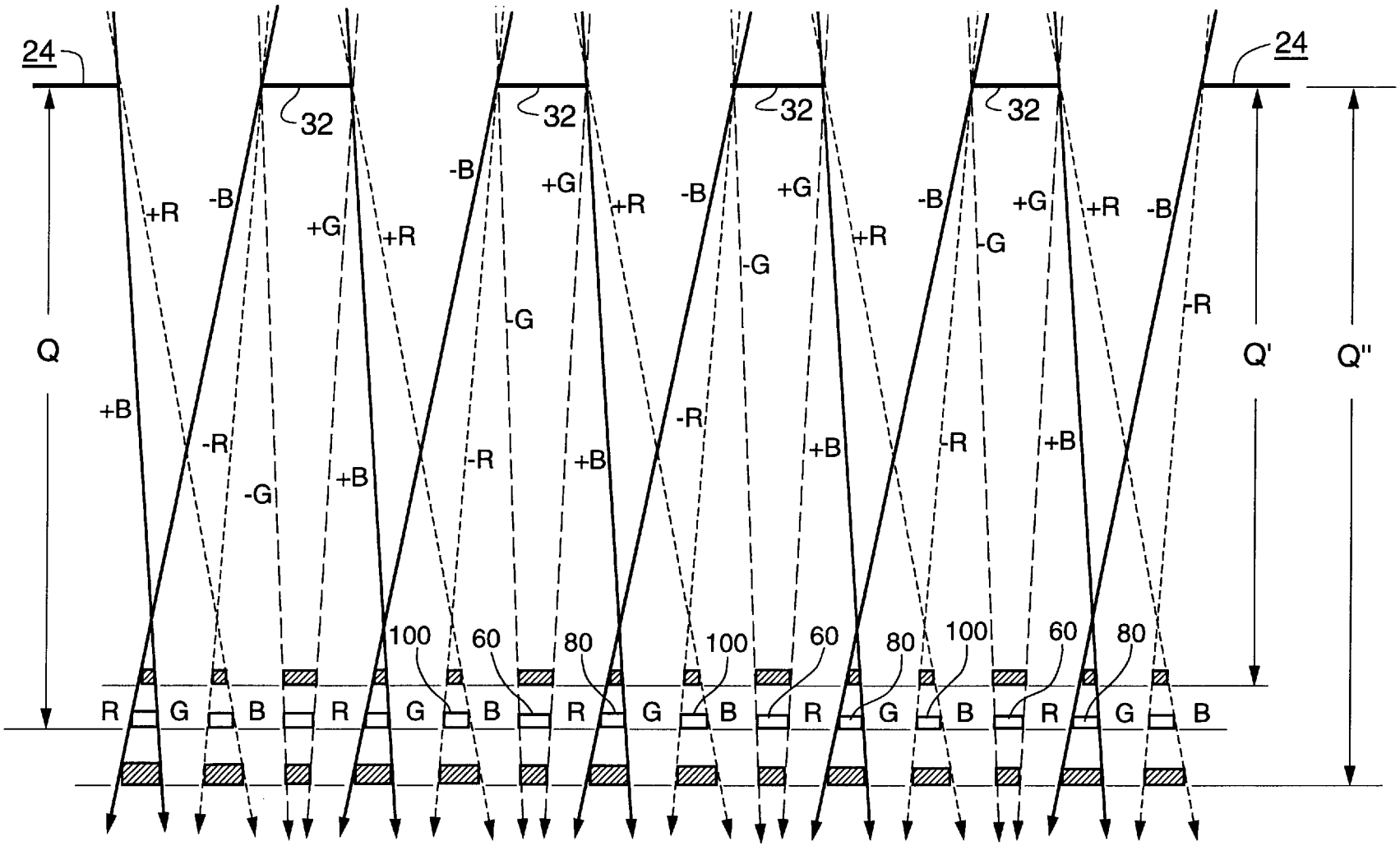
FIG. 24 shows how the guardbands and phosphor openings vary with changes in "Q"-spacing.

An advantage of the present process is shown in FIG. 24. If the Q-spacing varies, for example because of variations in the distance from the tension focus mask to the inside surface of the faceplate panel, then the R, B and B matrix openings also change, but remain equal in size. If the Q-spacing changes by −5% because of the aforementioned "Q-error", to a value of Q', then each of the matrix openings increases in width from the bogie dimension of 0.173 mm (6.8 mils) to about 0.189 mm (7.46 mils) and the guardbands, change as follows: the guardbands 60 increase in width from a bogie dimension of 0.127 mm (5 mils) to 0.139 mm (5.49 mils) while the guardbands 80 and 100 decrease in width from the bogie dimension of 0.127 mm (5 mils) to 0.0945 mm (3.72 mils). However, if the Q-spacing changes by +5%, then each of the matrix openings decreases in width to about 0.156 mm (6.14 mils), but the guardbands change in size as follows: the guardbands 60 decreases in width to 0.115 mm (4.51 mils) while the guardbands 80 and 100 increase in width to 0.160 mm (6.28 mils). These results are graphically shown in FIG. 25.

Figure 25:
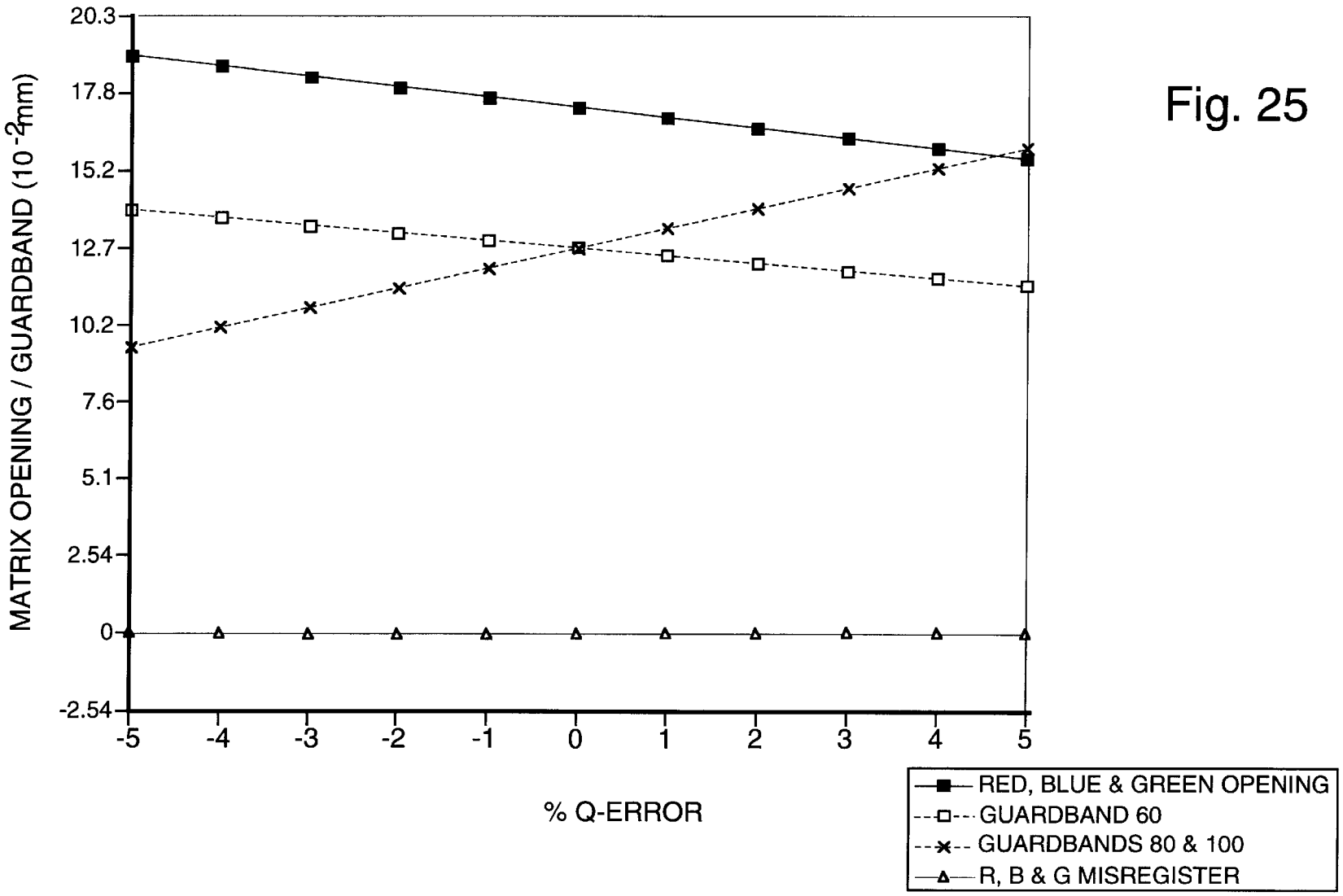
FIG. 25 is a graph of guardband width, phosphor opening width, and phosphor misregister as a function of % Q-error.

After the matrix is formed, the phosphor screen elements are deposited by a suitable method, such as that described in U.S. Pat. No. 5,455,133, issued to Gorog et al. on Oct. 3, 1996 and assigned to the Assignee of the present invention. The present method adjusts both the size of the matrix openings and the guardbands to take into consideration variations in Q-spacing. However, as shown in FIG. 25, there is no misregister in the red-, blue- and green-impinging electron beams as a result of the present process.

The present invention also is applicable to tension focus masks of finer pitch. For example where the tension focus mask has a mask pitch of 0.65 mm (25.6 mils) and a first strand width of 0.3 mm (11.8 mils), the corresponding screen pitch is 0.68 mm (26.8 mils). Each matrix opening has an optimum width, b, of about 0.132 mm (5.2 mils) and a matrix line width, c, of about 0.094 mm (3.7 mils). For this embodiment of the tension focus mask 24, the center Q-spacing is about 11.4 mm (449 mils).

Additionally, if the tension focus mask 24 has a mask pitch of 0.41 mm (16.1 mils) and a first strand width of 0.2 mm (7.8 mils), the corresponding screen pitch is 0.42 mm (16.5 mils). Each matrix opening has a width, b, of about 0.066 mm (2.6 mils) and a matrix line width, c, of about 0.074 mm (2.9 mils). In this embodiment of the tension focus mask 24, the center Q-spacing is about 7.4 mm (291.5 mils.

We claim:

1. A method of manufacturing a luminescent screen assembly with a light-absorbing matrix, having a plurality of substantially equally sized openings therein, on an inner surface of a CRT faceplate panel with a color selection electrode spaced from said inner surface of said faceplate panel by a distance, Q, said color selection electrode having a plurality of first strands interleaved with slots, said slots being wider than said first strands, said method comprising the steps of:

a) providing a first negative acting photoresist layer, whose solubility is altered when it is exposed to light, on the inner surface of the faceplate panel;

b) exposing, through said slots in said color selection electrode, said first negative acting photoresist layer to light from at least two symmetrically located source positions, +G and −G, relative to a central source position, 0, to selectively alter the solubility of the illuminated areas of said first negative acting photoresist layer, thereby producing shaded regions with greater solubility and illuminated regions with lesser solubility;

c) removing the shaded regions of said first negative acting photoresist layer with greater solubility, thereby uncovering areas of said inner surface of said faceplate panel, while retaining said illuminated regions of lesser solubility;

d) overcoating said areas and said retained illuminated regions with a composition of light-absorbing material;

e) removing said retained illuminated regions and the light-absorbing material thereon, thereby uncovering portions of said inner surface of said faceplate panel while retaining first guardbands of said light-absorbing material adhered to said inner surface of said faceplate panel;

f) repeating steps a) through e) twice more, using second and third negative acting photoresist layers and additional asymmetrically located light source positions +B,−B and +R,−R, respectively, to uncover portions of said inner surface of said faceplate panel and produce second and third guardbands of said light-absorbing material, each of the six light source positions being different from each other; and g) depositing phosphor materials onto the uncovered portions of the inner surface of the faceplate panel.

2. A method of manufacturing a luminescent screen assembly with a light-absorbing matrix, having a plurality of substantially equally sized openings therein, on an inner surface of a CRT faceplate panel with a color selection electrode spaced from said inner surface of said faceplate panel by a distance, Q, said color selection electrode having a plurality of first strands interleaved with slots, said slots being wider than said first strands, said method comprising the steps of:

providing, on said inner surface of said faceplate panel, a first negative acting photoresist layer whose solubility is altered when it is exposed to light;

exposing said first negative acting photoresist layer, through said slots in said color selection electrode, to light from at least two symmetrically located source positions, +G and −G, relative to a central source position, 0, to selectively alter the solubility of the illuminated areas of said first negative acting photoresist layer, thereby producing in said first negative acting photoresist layer shaded regions with greater solubility and illuminated regions with lesser solubility;

removing the shaded regions of said first negative acting photoresist layer with greater solubility thereby uncovering areas of said inner surface of said faceplate panel underlying said shaded regions of greater solubility, while retaining those illuminated regions of said first negative acting photoresist layer with lesser solubility;

overcoating said inner surface of said faceplate panel and said retained illuminated regions of said first negative acting photoresist layer with a composition of light-absorbing material which is adherent to said inner surface of said faceplate panel;

removing said retained illuminated regions of said first negative acting photoresist layer and the light absorbing material thereon, thereby uncovering portions of said inner surface of said faceplate panel while retaining first guardbands of said light absorbing material adhered to said inner surface of said faceplate panel;

providing a second negative acting photoresist layer, whose solubility is altered when exposed to light, on said uncovered portions of said inner surface of said faceplate panel and on the retained first guardbands of said light-absorbing material adhered to said inner surface of said faceplate panel;

exposing said second negative acting photoresist layer, through said slots in said color selection electrode, to light from at least two asymmetrically located source positions, +B and −B, to selectively alter the solubility of the illuminated areas of said second negative acting photoresist layer, thereby producing in said second negative acting photoresist layer shaded regions with greater solubility and illuminated regions with lesser solubility;

removing the shaded regions of said second negative acting photoresist layer with greater solubility, thereby uncovering areas of said inner surface of said faceplate panel underlying said shaded regions of greater solubility, while retaining those illuminated regions of said second negative acting photoresist layer with lesser solubility;

overcoating said inner surface of said faceplate panel and said retained illuminated regions of said second negative acting photoresist layer with a composition of light-absorbing material which is adherent to said inner surface of said faceplate panel;

removing said retained illuminated regions of said second negative acting photoresist layer and the light-absorbing material thereon, thereby uncovering portions of said inner surface of said faceplate panel while retaining second guardbands of said light-absorbing material adhered to said inner surface of said faceplate panel;

providing a third negative acting photoresist layer, whose solubility is altered when exposed to light, on said uncovered portions of said inner surface of said faceplate panel and on the retained first and second guardbands of light-absorbing material adhered to said inner surface of said faceplate panel;

exposing said third negative acting photoresist layer, through said slots in said color selection electrode, to light from at least two different asymmetrically located source positions, +R and −R, to selectively alter the solubility of the illuminated areas of said third negative acting photoresist layer, thereby producing in said third negative acting photoresist layer shaded regions with greater solubility and illuminated regions with lesser solubility, each of the six light source positions,+G, −G, +B, −B, +R and −R being different from each other;

removing the shaded regions of said third negative acting photoresist layer with greater solubility, thereby uncovering areas of said inner surface of said faceplate panel underlying said shaded regions of greater solubility, while retaining those illuminated regions of said third negative acting photoresist layer with lesser solubility;

overcoating said inner surface of said faceplate panel and said retained illuminated regions of said third negative acting photoresist layer with a composition of light-absorbing material which is adherent to said inner surface of said faceplate panel;

removing said retained illuminated regions of said third negative acting photoresist layer and the light-absorbing material thereon, thereby uncovering portions of said inner surface of said faceplate panel while retaining third guardbands of said light-absorbing material adhered to said inner surface of said faceplate panel; and then depositing phosphor materials, G, B, and R, on the uncovered portions of said inner surface of said faceplate panel.

* * * * *